US009806440B2

(12) United States Patent
Hoppmann et al.

(10) Patent No.: US 9,806,440 B2
(45) Date of Patent: Oct. 31, 2017

(54) TERMINAL BLOCK

(71) Applicant: Phoenix Contact GmbH & Co. KG, Blomberg (DE)

(72) Inventors: Ralph Hoppmann, Bad Oeynhausen (DE); Andrea Goetze, Horn-Bad Meinberg (DE); Wjatscheslaw Janzen, Detmold (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 0 days.

(21) Appl. No.: 15/103,915

(22) PCT Filed: Dec. 11, 2014

(86) PCT No.: PCT/EP2014/077376
§ 371 (c)(1),
(2) Date: Jun. 13, 2016

(87) PCT Pub. No.: WO2015/091203
PCT Pub. Date: Jun. 25, 2015

(65) Prior Publication Data

US 2016/0315402 A1 Oct. 27, 2016

(30) Foreign Application Priority Data

Dec. 18, 2013 (DE) ..... 10 2013 114 272

(51) Int. Cl.
*H01R 9/22* (2006.01)
*H01R 9/26* (2006.01)
(Continued)

(52) U.S. Cl.
CPC ..... *H01R 9/26* (2013.01); *H01R 4/242* (2013.01); *H01R 9/2491* (2013.01);
(Continued)

(58) Field of Classification Search
CPC .... H01R 4/4872; H01R 24/20; H01R 4/4836; H01R 4/4845; H01R 4/4818; H01R 4/32; H01R 4/489
See application file for complete search history.

(56) References Cited

U.S. PATENT DOCUMENTS 5,816,867 A * 10/1998 Davidsz ..... H01R 4/4818 439/828
5,853,304 A * 12/1998 Landreau ..... H01R 31/085 439/716

(Continued)

FOREIGN PATENT DOCUMENTS

DE 9000398 U1 3/1990
DE 29502347 U 4/1995

(Continued)

*Primary Examiner* — Xuong Chung Trans
(74) *Attorney, Agent, or Firm* — Leydig, Voit & Mayer, Ltd.

(57) ABSTRACT

A terminal block has an insulator housing, at least two busbars and at least four connection elements, there being at least two connection levels in the insulator housing arranged one over the other. Each connection level has a busbar receptacle chamber for receiving a busbar and two mutually opposite conductor connection chambers on ends of chamber for receiving a respective connection element, the chambers being open on an insulator housing first side for busbar assembly in the chambers and wherein the conductor connection chambers are open on a second side of the insulator housing for assembly of the connection elements in the conductor connection chambers. The insulator housing first side is designed at a right angle to the insulator housing second side to give an busbar assembly insertion direction into a chamber at a right angle to a connection element assembly insertion direction into a conductor connection chamber.

16 Claims, 6 Drawing Sheets

(51) Int. Cl.

| | |
|---|---|
| ***H01R 4/24*** | (2006.01) |
| ***H01R 9/24*** | (2006.01) |
| ***H01R 31/08*** | (2006.01) |
| *H01R 13/627* | (2006.01) |

(52) U.S. Cl.
CPC ..... *H01R 13/6273* (2013.01); *H01R 31/085* (2013.01); *H01R 13/6272* (2013.01)

(56) References Cited

U.S. PATENT DOCUMENTS

| | | | | |
|---|---|---|---|---|
| 7,192,316 | B1 * | 3/2007 | Pollmann | H01R 9/2675 439/716 |
| 7,438,604 | B2 * | 10/2008 | Andresen | H01R 4/4818 439/709 |
| 7,686,626 | B2 * | 3/2010 | Wu | H01R 4/64 439/95 |
| 7,862,389 | B2 * | 1/2011 | Pizzi | H01R 4/28 439/709 |
| 2014/0213117 | A1 | 7/2014 | Trinh et al. | |

FOREIGN PATENT DOCUMENTS

| | | | |
|---|---|---|---|
| DE | 202007005385 | U1 | 6/2007 |
| DE | 202007004624 | U1 | 7/2008 |
| DE | 102008009986 | A1 | 7/2009 |
| DE | 202009013335 | U1 | 12/2010 |
| DE | 202009017067 | U1 | 5/2011 |
| DE | 202010005554 | U1 | 10/2011 |
| DE | 102012010391 | A1 | 12/2012 |
| EP | 2393160 | A1 | 12/2011 |

* cited by examiner

TERMINAL BLOCK

CROSS-REFERENCE TO RELATED APPLICATIONS

This application is a U.S. national stage application under 35 U.S.C. §371 of International Application No. PCT/EP2014/077376, filed on Dec. 11, 2014, and claims benefit to German Patent Application No. DE 10 2013 114 272.9, filed on Dec. 18, 2013. The International Application was published in German on Jun. 25, 2015, as WO 2015/091203 A1 under PCT Article 21(2).

FIELD

The invention relates to a terminal block, in particular a shunt terminal.

BACKGROUND

Terminal blocks which can be latched onto a mounting rail are known in various constructions. In particular, terminal blocks in the form of shunt terminals of a stage construction are known, such as are disclosed for example in DE 29502347 U. They are used for wiring systems, and are in particular for distributing one or more potentials. A terminal block in the form of a shunt terminal conventionally has two or more than two busbars arranged above one another, the ends of which are each connected to connection elements. The busbars and the connection elements are conventionally installed in the insulator housing of the terminal block in the same installation direction, both the busbars and the connection elements being installed via the front, open longitudinal side of the terminal block. To prevent the busbars and/or the connection elements from being able to come free from the insulator housing unintentionally, for example in the event of vibrations, fastening devices conventionally have to be provided inside the housing, and secure the busbars and/or the connection elements in the insulator housing. This makes it difficult to install or equip the terminal blocks, in particular with the busbars and the connection elements.

SUMMARY

In an embodiment, the present invention provides a terminal block, comprising: an insulator housing; at least two busbars; and at least four connection elements arranged one above the other so as to form at least two connection levels in the insulator housing. Each connection level includes: a busbar receiving chamber, configured to receive one of the busbars, and a first conductor connection chamber and a second conductor connection chamber, the conductor connection chambers being mutually opposite each other and formed on ends of the busbar receiving chamber, each conductor connection chamber being configured to receive a respective one of the connection elements, wherein the busbar receiving chambers are formed open on a first side of the insulator housing for installation of the busbars in the busbar receiving chambers. The conductor connection chambers are formed open on a second side of the insulator housing for installation of the connection elements in the conductor connection chambers, wherein the first side of the insulator housing is formed perpendicular to the second side of the insulator housing, in such a way that a busbar installation insertion direction for inserting one of the busbars into the respective busbar receiving chamber is formed perpendicular to a connection element installation insertion direction for inserting one of the connection elements into the respective conductor connection chambers.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
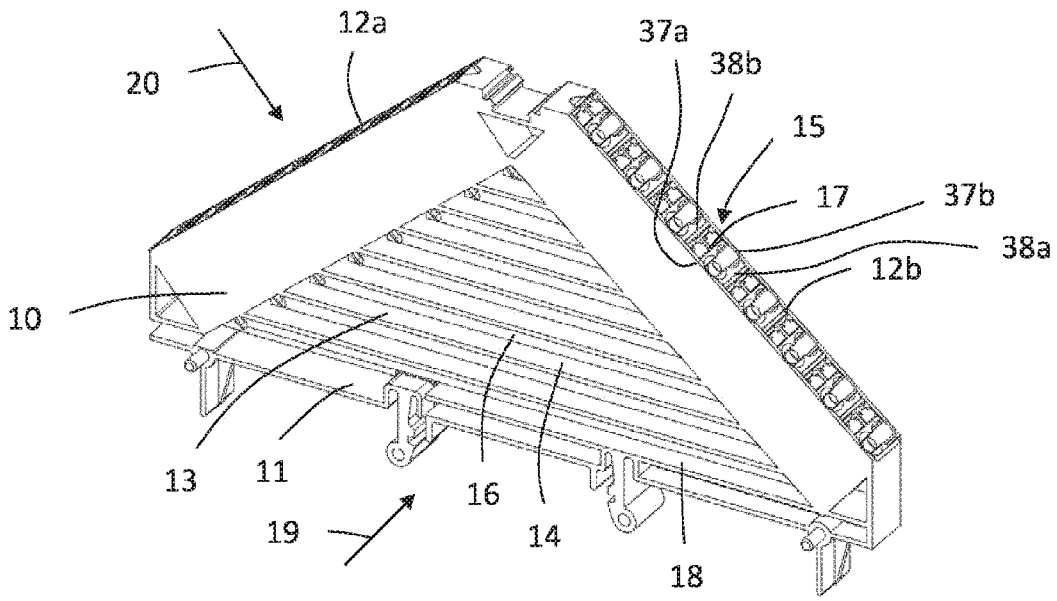
FIG. 1 is a schematic perspective drawing of a terminal block according to the invention.

An aspect of the invention is therefore to provide a terminal block in which the installation or equipping can be improved.

The terminal block according to an aspect of the invention is distinguished in that it has an insulator housing, at least two busbars and at least two connection elements, at least two connection levels being formed in the insulator housing, each connection level having a busbar receiving chamber for receiving a busbar and two mutually opposite conductor connection chambers formed on the ends of the busbar receiving chamber, each for receiving a connection element, the busbar receiving chambers being formed open on a first side of the insulator housing for installation of the busbars in the busbar receiving chambers, and the conductor connection chambers being formed open on a second side of the insulator housing for installation of the connection elements in the conductor connection chambers, the first side of the insulator housing being formed perpendicular to the second side of the insulator housing, in such a way that an installation direction for inserting a busbar into a busbar receiving chamber is formed perpendicular to an installation direction for inserting a connection element into a conductor connection chamber.

According to an aspect of the invention, it is thus provided that the busbars and the connection elements are no longer installed in the insulator housing using the same installation direction, but instead the connection elements can be inserted into and installed in the insulator housing using a different installation direction from the busbars. The connection elements and the busbars are thus also no longer inserted into the insulator housing via the same side of the insulator housing, but instead via different sides of the insulator housing arranged at an angle to one another. In particular, the connection elements are now no longer inserted into the insulator housing via the front, open longitudinal side of the insulator housing or the terminal block, but instead the connection elements are inserted into the insulator housing via transverse sides of the insulator housing which are arranged perpendicular to the front, open longitudinal side of the insulator housing. By contrast, the busbars are still preferably inserted into the insulator housing via the front, open longitudinal side of the insulator housing. The busbars and the connection elements are preferably installed in the insulator housing in such a way that in a first installation step the busbars are inserted into or installed in the busbar receiving chambers via the first side, in particular the front, open longitudinal side, of the insulator housing. In a subsequent, second installation step, the connection elements can be inserted into or installed in the conductor connection chambers via the second side, in particular the transverse side, of the insulator housing. When the connection elements are inserted into the conductor connection chambers, the connection elements may additionally be contacted with the busbars directly, in that the connection bodies can be placed and installed on the busbars from above and directly contacted because of the different installation directions of the busbars and of the connection elements. The contacting can thus take place automatically when the connection elements are inserted into the conductor connection chambers, in such a way that further installation steps are not required. As a result of the connection bodies being contacted with the busbars automatically, a holding support for the busbars inside the busbar receiving chambers can also be formed simultaneously by the connection elements, in such a way that the busbars can be fixed in the insulator housing by means of the connection elements and can thus be secured against coming free or falling out, even in the event of relatively strong loads such as vibrations. A further advantage results from the fact that the connection elements can be installed in the corresponding conductor connection chambers in blocks, in other words two or more connection elements together, because of the special installation direction thereof, in such a way that the installation time can also be reduced, in addition to an improvement in the handling during installation for a user. The conductor connection chambers preferably have four side walls, which enclose one or more connection elements inserted into a conductor connection chamber. The side walls of the conductor connection chambers form an insulation, in such a way that enclosing one or more connection elements with the side walls of the conductor connection chambers makes it possible to achieve large insulation distances. This in turn results in the advantage of the possibility of a very compact construction.

The busbars may be in the form of a flat strip, a round wire and/or a flexible conductor. The busbars arranged in a terminal block may also be formed differently from one another, in such a way that a terminal block may for example comprise a busbar formed as a round wire, a busbar formed as a flat strip and a busbar formed as a flexible conductor. The flexible conductor preferably has a sheathing, it being possible to remove the sheathing at the appropriate points for contacting before the busbar formed as a flexible conductor is laid in the receiving chamber. However, it is also possible for the flexible conductor to be laid in the busbar receiving chamber together with the entire sheathing thereof and for the sheathing to be able to be cut from the connection element when the busbar formed as a flexible conductor is contacted, so as to be able to form electrical contact of the busbar formed as a flexible conductor with the connection element. The sheathing may act as electrical shielding, in such a way that the number of walls inside the insulator housing which provide shielding can be reduced. For example, the walls between two busbars or between two busbar receiving chambers may be omitted. The use of a flexible conductor as a busbar makes possible defined cutting and thus adaptation of the length of the busbar to the size of the busbar receiving chamber shortly before installation, in such a way that high flexibility during installation can be achieved. In addition, the use of a flexible conductor makes it possible for the length of the busbar to expand and contract as a result of temperature fluctuations, in such a way that frictional corrosion between the busbar and the connection body in the region of the contact can be compensated or prevented by way of the flexibility of the electrical conductor and thus of the busbar. The wear on the busbar or the connection element can be reduced in such a way that the service life of the terminal block or of the individual elements of the terminal block can be increased. If the busbar is formed as a flat strip, it may be arranged both flat and on edge in the busbar receiving chamber. In addition to the formation of the busbar as a round wire, the busbar may also be in the form of a polygon, for example a hexagon.

A connection element preferably has a spring clamp connection having at least one clamping spring and at least one contact wall. A conductor inserted into the connection element can be pressed against the contact wall by the clamping spring and thus be clamped so as to be able to form electrical contact, in particular with the busbar. In addition to the clamping spring and the contact wall, the spring clamp connection may also have a pusher for actuating the clamping spring. The spring clamp connection may be inserted into a main housing of the connection element as a preassembled module, making it possible to reduce the installation effort and installation time, since the fully preassembled module can be inserted into the conductor connection chamber as a unit. If the conductor connection chamber has four side walls, one of these side walls or two mutually opposite side walls of these four side walls may act as a guide for the pusher, in such a way that the connection element does not itself require a side wall in the form of a housing. The size of the connection element can thus be reduced.

However, as an alternative to the spring clamp connection, the connection elements may also each have a screw connection. It is also possible for both a connection element having a spring clamp connection and a connection element having a screw connection to be arranged in a terminal block.

So as to be able to achieve a defined position of a busbar in a busbar receiving chamber, the busbar receiving chamber may have at least one busbar positioning element. Preferably, two or more busbar positioning elements are provided in a busbar receiving chamber. The contour of a busbar positioning element is preferably adapted to the contour of the busbar to be inserted, in such a way that optimum placement, secured against slipping, of the busbar on a busbar positioning element can be achieved.

A connection element preferably has a busbar contact element for contacting the connection element with a busbar, it being possible for the busbar contact element to be in the form of a fork contact, insulation displacement contact or pierce contact. The busbar contact elements are preferably formed in such a way that they can be contacted with the busbar directly during the installation of the connection element. In addition, in the contacted state, the busbar contact elements can reliably prevent the busbar from being able to come free from the associated busbar receiving chamber unintentionally.

If the connection element is in the form of a spring clamp connection, the busbar contact element is preferably connected to the contact wall of the spring clamp connection, the busbar contact element preferably being connected directly to the contact wall, and the busbar contact element preferably being formed integrally with the contact wall of the spring clamp connection.

In particular if the busbar contact element is formed integrally with the contact wall of the spring clamp connection, it may be provided that the busbar contact element is formed bent out from the contact wall of the spring clamp connection. If the busbar contact element is bent out from the contact wall directly, the material outlay for the connection element can be reduced.

The busbar contact element and the spring clamp connection may preferably be formed in the connection element in such a way that the busbar contact element can project out of the spring clamp connection. As a result, the busbar contact element can be contacted with a busbar as early as possible during the installation process, it being possible for contact of the busbar contact element with the busbar to be established even before complete insertion of the connection element into a conductor connection chamber.

So as to be able to achieve reliable and rapid installation, in particular in the case of a busbar contact element projecting out from the spring clamp connection, it may preferably be provided that the busbar positioning element has a guide which can cooperate with a busbar contact element of a connection element. This is advantageous in particular if the busbar is in the form of a flexible conductor and the busbar contact element is formed as an insulation displacement contact, since when the sheathing of the flexible conductor is cut by the insulation displacement contact, slipping or sliding of the insulation displacement contact can be prevented by the guide of the busbar positioning element.

So as to be able to ensure that the guide of the busbar positioning element extends in the installation or insertion direction of the connection element, and thus in the insertion direction of the insulation displacement contact, it is preferably provided that the busbar positioning element is arranged at an inclination to a busbar inserted into a busbar receiving chamber. Preferably, the busbar positioning element is arranged inclined at an angle of between 30° and 70° to the busbar inserted into the busbar receiving chamber.

So as to be able to form or arrange the busbar positioning element in the busbar receiving chamber compactly and with savings on material, the busbar positioning element may have two web elements arranged mutually parallel.

As an alternative to forming a connection element with a busbar contact element, it may also be provided that a busbar has an end portion which projects into a connection element when the connection element is installed together with the busbar. As a result of a sub-region of a busbar being inserted into an interior of a connection element, the busbar can hook onto the connection element inside the connection element, in such a way that the busbar can be secured against sliding out of the busbar receiving chamber by means of the connection element. During the installation of the connection element, when the connection element is inserted into the conductor connection chamber, the end portion, preferably formed elbowed off from the remaining region of the busbar, of the busbar already arranged in the busbar receiving chamber may automatically penetrate into the connection element, in such a way that, without further handling or installation steps, contact can be formed as early as the process of inserting the connection element into a conductor connection chamber, and thus when the connection element is placed on the end portion of the busbar or the end portion of the busbars is inserted into the interior of the connection element.

The contact of the busbar with the connection element can be established for example in that, when the connection element is installed together with the busbar, the end portion of the busbar is positioned against the contact wall of the spring clamp connection inside the connection element.

So as to be able to establish particularly reliable contact, it may be provided that the spring clamp connection has a fixing element which presses the end portion of the busbar against the contact wall when the connection element is installed together with the busbar.

The fixing element may for example be in the form of a lug bent out from the contact wall, in such a way that the fixing element can be formed without additional material outlay.

If the spring clamp connection has two or more clamping springs, the end portion of the busbar may be formed fork-shaped and form two or more contact points. The spring clamp connection may thus be formed as a double or multiple connection, it being possible for example for the spring clamp connection to be formed symmetrically, and thus to be used on both sides, if the spring clamp connection is formed as a double connection.

Further, it may preferably be provided that a rear wall of the insulator housing may have at least one opening for inserting a latch element into the insulator housing. This is advantageous in particular if one or more busbars are in the form of flexible conductors, since the sheathing of the flexible conductor forms an insulation, in such a way that the insulation conventionally formed from parts of the insulator housing is not necessarily required or can be reduced as a result of openings for receiving latch elements being provided. By means of the openings and the latch elements, for example terminal blocks arranged in succession or insulator housings of the terminal blocks can be interconnected.

Figure 2:
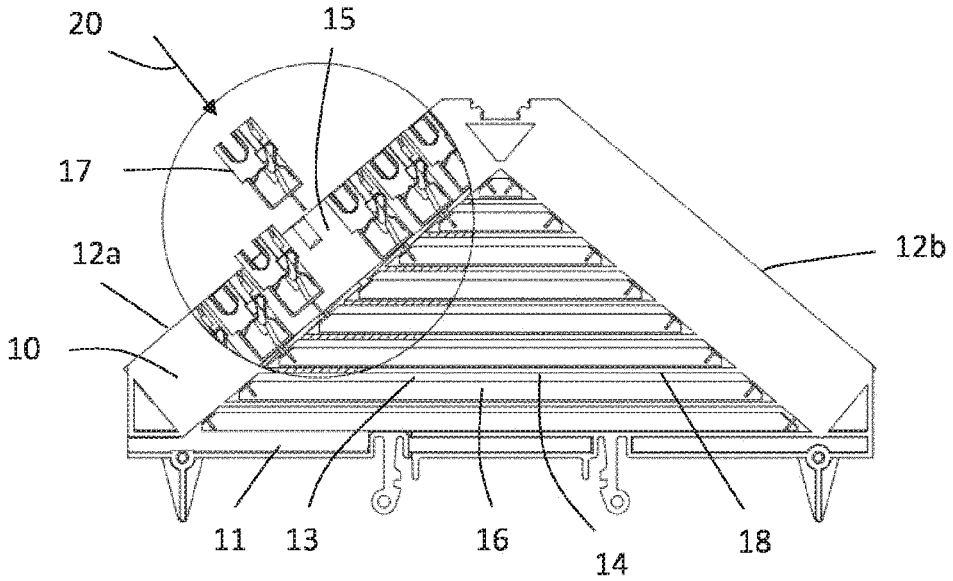
FIG. 2 is a schematic plan view from the front of the terminal block shown in FIG. 1, with a region shown in section in part.

FIGS. 1 and 2 show a terminal block in the form of a shunt terminal. The terminal block has an insulator housing 10 which is formed triangular. The terminal block or the insulator housing 10 of the terminal block has a base 11 by means of which the terminal block can for example be latched to a mounting rail. At an angle, preferably at an angle of 45°, to the base 11, the terminal block or the insulator housing 10 of the terminal block has two transverse sides 12*a*, 12*b* arranged at a 90° angle to one another.

The insulator housing 10 has a plurality of connection levels 13 arranged above one another, the terminal block shown in FIGS. 1 and 2 having eight connection levels 13 arranged above one another. Each connection level 13 has a busbar receiving chamber 14 oriented parallel to the base 11 and two mutually opposite conductor connection chambers 15 formed on the ends of the busbar receiving chamber 14. In each busbar receiving chamber 14, a busbar 16 is received, which is arranged parallel to the base 11 of the insulator housing 10. In each conductor connection chamber 15, a connection element 17 is received, the connection element 17 acting to receive and contact a conductor (not shown) or a cable.

The busbar receiving chambers 14 are formed open on a first side of the insulator housing 10, in each case for installing a busbar 16 in a busbar receiving chamber 14. The first side of the insulator housing 10 is in this case formed by a front, open longitudinal side 18 of the insulator housing 10. During the installation of the busbars 16 in the respective busbar receiving chambers 14, the busbars 16 are laid in the insulator housing 10, and thus in the busbar receiving chambers 14 of the insulator housing 10, via this first side, in other words the front, open longitudinal side 18 of the insulator housing 10. The installation direction of the busbars 16 when being laid in the busbar receiving chambers 14 is illustrated by the arrow 19.

The conductor connection chambers 15 are formed open on a second side of the insulator housing 10 for installing the connection elements 17 in the conductor connection chambers 15. The second side of the insulator housing 10 is in this case formed by the transverse sides 12*a*, 12*b* of the insulator housing 10. During the installation of the connection elements 17 in the respective conductor connection chambers 15, the connection elements 17 are inserted into the insulator housing 10, and thus into the conductor connection chambers 15 of the insulator housing 10, via this second side, in other words the transverse sides 12*a*, 12*b* of the insulator housing 10. The installation direction of the connection element 17 when being inserted into the conductor connection chambers 15 is illustrated by way of the arrow 20.

The installation directions shown by the arrows 19, 20 are formed mutually perpendicular, and are therefore no longer in the same direction, as is conventionally provided.

The connection elements 17, which when installed are contacted with the busbars 16 directly, can be formed differently, as is shown in FIGS. 3-8, 11 and 12.

Figure 3:
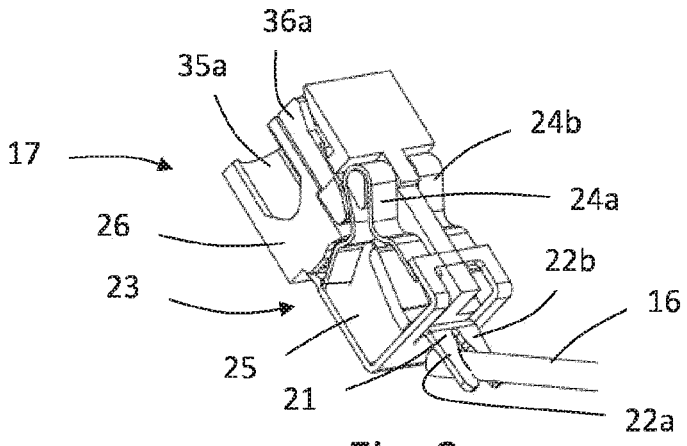
FIG. 3 is a schematic drawing of a connection element having a busbar according to a first embodiment of the invention.

The connection element 17 shown in FIG. 3 has a busbar contact element 21 for contacting the connection element 17 with the busbar 16, the busbar 16 in this case being formed as a round wire. In the embodiment shown in FIG. 3, the busbar contact element 21 is in the form of a fork contact, in such a way that the busbar 16, when contacted as shown in FIG. 3, is clamped between two arms 22*a*, 22*b* of the busbar contact element 21.

For clamping or connecting a conductor or cable, the connection element 17 further has a spring clamp connection 23, the spring clamp connection 23 shown in this case basically having two clamping springs 24*a*, 24*b* and a contact wall 25 which is formed bent, bent in a U shape in the embodiment shown. The spring clamp connection 23 is inserted into a main housing 26 of the connection element 17 as a pre-assembled module, two conductor insertion openings 35*a*, 35*b* being formed in the main housing 26, via each of which a conductor or cable can be inserted into the connection element 17, in particular into the spring clamp connection 23 of the connection element 17, so as to be able to be clamped contacted against the contact wall 25 inside the spring clamp connection 23 by means of the clamping springs 24*a*, 24*b*.

The busbar contact element 21 is formed integrally with the contact wall 25 of the spring clamp connection 23, the busbar contact element 21 being formed bent out from the contact wall 25 and thus projecting out from the spring clamp connection 23 in the manner of a lug.

Figure 4:
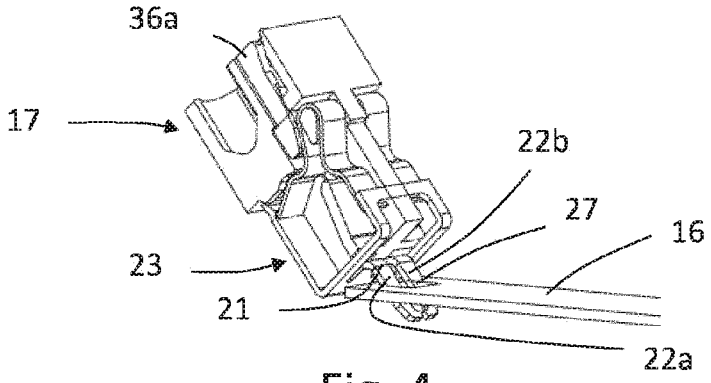
FIG. 4 is a schematic drawing of a connection element having a busbar according to a second embodiment of the invention.

The embodiment shown in FIG. 4 substantially corresponds to the embodiment shown in FIG. 3, but in the embodiment shown in FIG. 4 the busbar 16 in the form of a flat strip has a window-like opening 27, into which the busbar contact element 21 is inserted so as to be electrically conductively contacted with the busbar 16. In this case too, the busbar contact element 21 has two arms 22*a*, 22*b*, which are pressed into the window-like opening 27 of the busbar 16 and thus press against the edges of the window-like opening 27 when the busbar contact element 21 is inserted into the window-like opening 27, so as to be able to establish reliable contact with the busbar 16.

Figure 5:
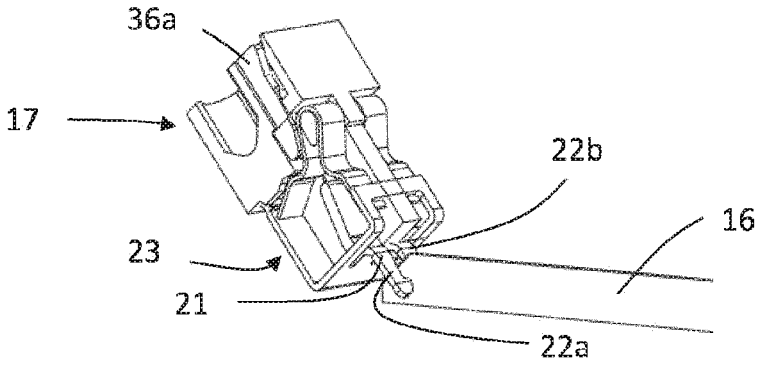
FIG. 5 is a schematic drawing of a connection element having a busbar according to a third embodiment of the invention.

In the embodiment shown in FIG. 5, the busbar contact element 21 is in the form of a fork contact, just as in the embodiment shown in FIG. 3, but in this case the busbar 16 is in the form of a flat strip which is laid on edge in the busbar receiving chamber 13, in such a way that the busbar 16 can be clamped between the arms 22*a*, 22*b* of the busbar contact element 21 formed as a fork contact.

Figure 6:
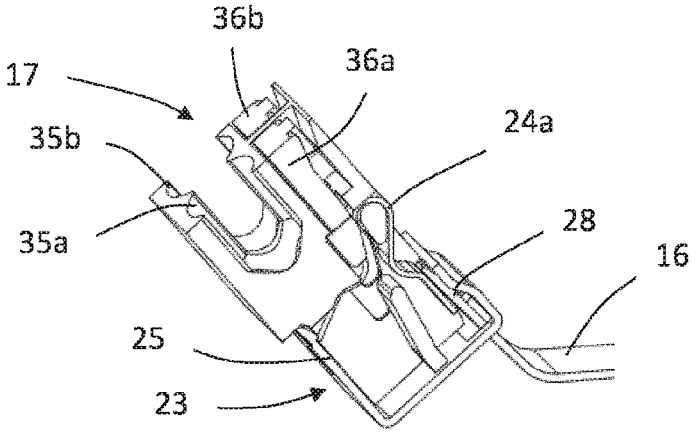
FIG. 6 is a schematic drawing of a connection element having a busbar according to a fourth embodiment of the invention.
Figure 7:
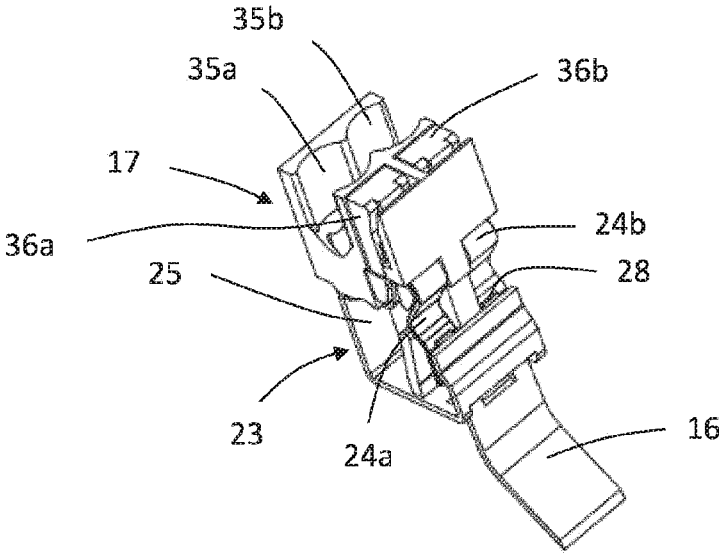
FIG. 7 is a further schematic drawing of the embodiment shown in FIG. 6.
Figure 8:
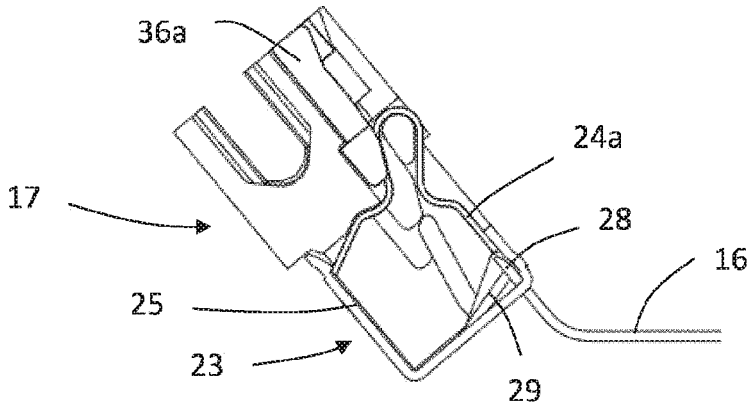
FIG. 8 is a schematic drawing of a connection element having a busbar according to a fifth embodiment of the invention.

In the embodiments shown in FIG. 6-8, the connection element 17 does not have a busbar contact element 21, but instead the busbar 16 has an end portion 28 which projects into the connection element 17 when the busbar 16 is assembled together with the connection element 17 as shown in FIG. 6-8. Inside the connection element 17, the end portion 28, inserted into the connection element 17, of the busbar 16 is positioned against the contact wall 25 so as to be able to form electrical contact.

In the embodiment shown in FIGS. 6 and 7, when the busbar 16 is inserted into the connection element 17, the end portion 28 of the busbar 16 is clamped between a region of the contact wall 25 and a clamping limb of the clamping springs 24*a*, 24*b*, the end portion 28 of the busbar 16 being pressed, by the clamping limb of the clamping springs 24*a*, 24*b*, against the region of the contact wall 25 against which the end portion 28 of the busbar 16 is positioned.

As can be seen in FIG. 7, the end portion 28 of the busbar 16 may be formed fork-shaped, in such a way that the busbar 16 can form two or more contact points.

In the embodiment shown in FIG. 8, just as in the embodiments shown in FIGS. 6 and 7, an end portion 28 of the busbar 16 is inserted into the connection element 17, in particular into the spring clamp connection 23 of the connection element 17. However, the end portion 28 of the busbar 16 does not project into the connection element 17 as far as is shown in the embodiments shown in FIGS. 6 and 7, in such a way that, in the embodiment shown in FIG. 8, the end portion 28 of the busbar 16 is also not held clamped between the clamping spring 24*a*, 24*b* and a region of the contact wall 25.

By contrast, in the embodiment shown in FIG. 8, the spring clamp connection 23 has a fixing element 29 which is formed separately from the clamping springs 24*a*, 24*b* and by means of which, when the busbar 16 is assembled together with the connection element 17, the end portion 28 of the busbar 16 is pressed against a region of the contact wall 25. The fixing element 29 is in this case formed as a lug bent out from the contact wall 25.

Figure 9:
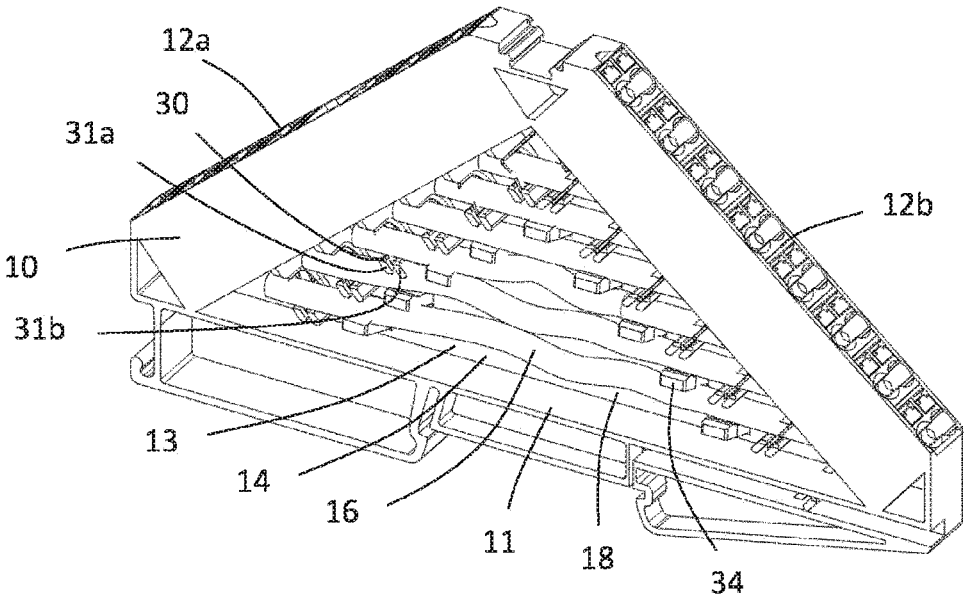
FIG. 9 is a schematic drawing of a terminal block according to a further embodiment.
Figure 10:
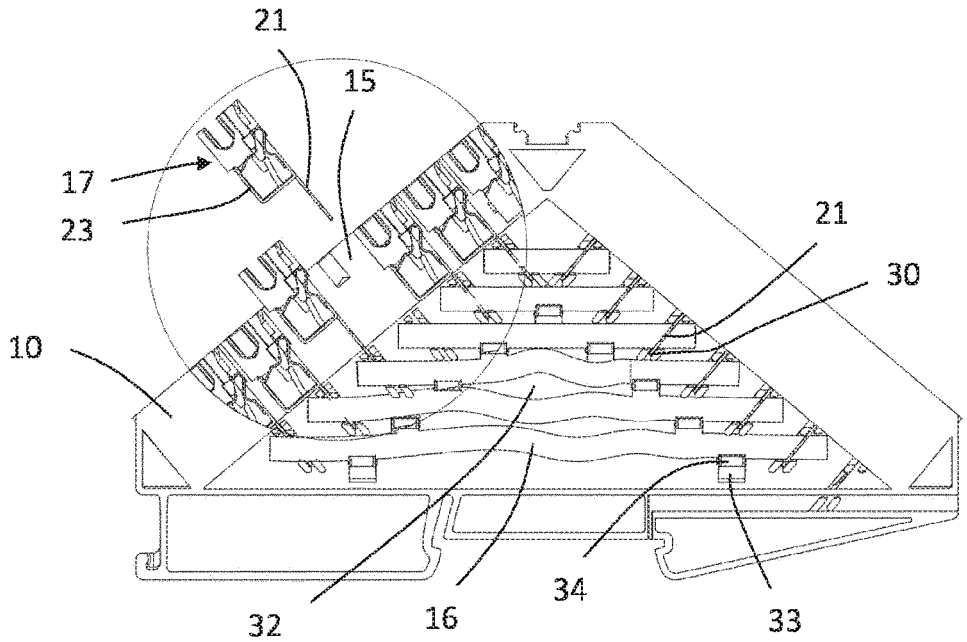
FIG. 10 is a schematic plan view from the front of the terminal block shown in FIG. 9 having a region shown in section in part.

FIGS. 9 and 10 show an embodiment of the terminal block in which the busbar 16 is formed from a flexible conductor. The busbar 16 formed from a flexible conductor has an insulating sheathing which can be cut to form electrical contact of the busbar 16 with a connection element 17.

In the embodiment shown in FIGS. 9 and 10, two busbar positioning elements 30, on which the busbars 16 are positioned when installed, as shown in FIGS. 9 and 10, are additionally provided for each busbar receiving chamber 14. Between the busbar positioning elements 30, the busbars 16 are preferably exposed, in such a way that they are not positioned on any surface. This makes freedom of movement possible for the busbars 16 inside the busbar receiving chamber 14 thereof, in such a way that the busbars 16 in the form of flexible conductors can expand and contract freely in the event of changes in temperature.

The busbar positioning elements 30 each have a guide, and these guides can each cooperate with a busbar contact element 21 of a connection element 17 in that, during the process of contacting the busbar 16 with the busbar contact elements 21 of the connection elements 17, the busbar contact elements 21 can be guided in the guide.

To facilitate the guidance of the busbar contact elements 21, the busbar positioning elements 30 are arranged at an inclination to the busbars 16 inserted into the busbar receiving chambers 14. In this case, the busbar positioning elements 30 are each arranged inclined at an angle of between 30° and 70° to the busbar 16 inserted into the busbar receiving chamber 14.

The busbar positioning elements 30 each have two web elements 31*a*, 31*b* arranged mutually parallel, which are formed at inclination to the busbar 16, the guide for the busbar contact element 21 being formed between two web elements 31*a*, 31*b* arranged mutually parallel. Thus, when the busbar contact element 21 is contacted with the busbar 16, in the embodiment shown in FIGS. 9 and 10, a busbar contact element 21 is arranged with the arms 22*a*, 22*b* thereof between two web elements 31*a*, 31*b*, arranged mutually parallel, of a busbar positioning element 30.

So as to be able to ensure that the busbars 16 are received securely, in particular if no walls of the insulator housing 10 are formed between busbar receiving chambers 14 formed mutually adjacent, the busbar positioning elements 30 and in particular the web elements 31*a*, 31*b* of the busbar positioning elements 30 may be formed C-shaped, as can be seen in particular in FIG. 9.

As is shown in particular in FIG. 10, the insulator housing 10 shown in FIGS. 9 and 10 has a plurality of openings 33 on the rear wall 32 thereof, in each of which a latch element 34 is passed through so as to connect the insulator housing 10 for example to a further insulator housing of a terminal block.

Figure 11:
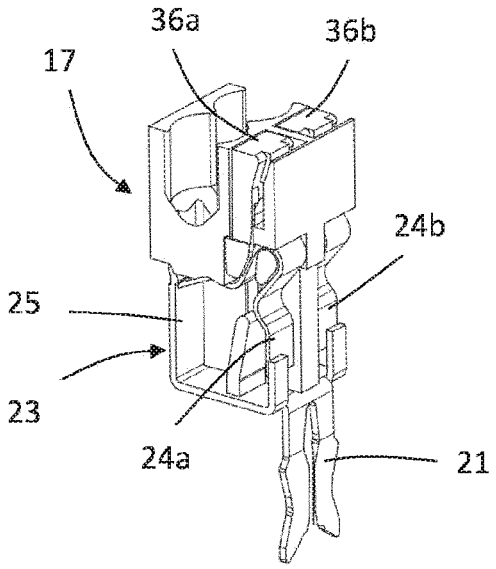
FIG. 11 is a schematic drawing of a connection element having a busbar according to a sixth embodiment of the invention.
Figure 12:
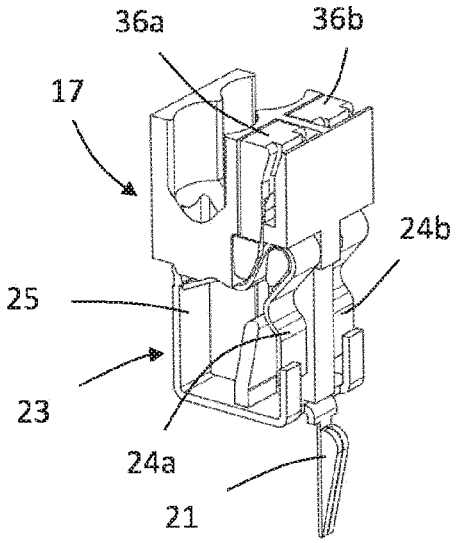
FIG. 12 is a schematic drawing of a connection element having a busbar according to a seventh embodiment of the invention.

FIGS. 11 and 12 show two further embodiments of connection elements 17, the busbar contact element 21 being formed as a fork-shaped insulation displacement contact in the embodiment shown in FIG. 11 and the busbar contact element 21 being formed as a pierce contact in the embodiment shown in FIG. 12. These configurations of busbar contact elements 21 are suitable in particular if the busbars 16 are in the form of flexible conductors, since by means of the busbar contact elements 21 shown in FIGS. 11 and 12 the sheathing of the busbars 16 formed as flexible conductors can be cut during the installation process and thus when a contact element 17 is being contacted with a busbar 16.

Both in the embodiment shown in FIG. 11 and in the embodiment shown in FIG. 12, the busbar contact elements 21 are integrally connected to the contact wall 25 of the spring clamp connection 23.

Figure 13:
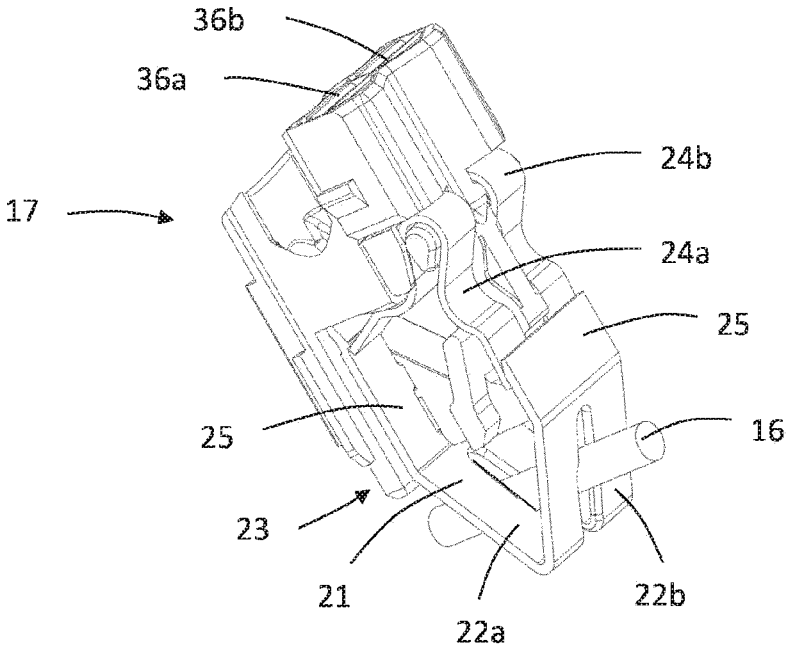
FIG. 13 is a schematic drawing of a connection element having a busbar according to an eighth embodiment of the invention.

FIG. 13 shows a further possible configuration of a connection element 17 in which the busbar contact element 21 is configured fork-shaped with two arms 22*a*, 22*b* formed mutually parallel, the busbar 16 being clamped contacted between the two arms 22*a*, 22*b*. By contrast with the fork-shaped busbar contact elements 21 shown in FIG. 3-5, the busbar contact element 21 is bent out from the contact wall 25 in a V shape, the two ends of the busbar contact element 21 being integrally linked to the contact wall 25, making it possible to increase the contact force.

As is shown in particular in FIG. 3-8 and FIG. 11-13, the connection elements 17 have no side walls, in such a way that the connection element 17 is formed open to the side of the clamping springs 24*a*, 24*b* and also to the side of the pushers 36*a*, 36*b* for actuating the clamping springs 24*a*, 24*b*. To prevent the pushers 36*a*, 36*b* from tilting during a displacement movement for actuating the clamping springs 24*a*, 24*b*, the side walls 37*a*, 37*b* of the conductor connection chambers 15 act to guide the pushers 36*a*, 36*b*, as is shown by way of example in FIG. 1.

In addition to the two mutually opposing, longitudinally extending side walls 37*a*, 37*b*, each conductor connection chamber 15 has two side walls 38*a*, 38*b* extending transverse thereto, in such a way that a conductor connection chamber 15 has four side walls 37*a*, 37*b*, 38*a*, 38*b* in total, which laterally enclose a connection element 17 inserted into the conductor connection chamber 15.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

LIST OF REFERENCE NUMERALS

Insulator housing 10
Base 11
Transverse side 12*a*, 12*b*

Connection level 13
Busbar receiving chamber 14
Conductor connection chamber 15
Busbar 16
Connection element 17
Longitudinal side 18
Busbar installation direction 19
Connection element installation direction 20
Busbar contact element 21
Arm 22*a*, 22*b*
Spring clamp connection 23
Clamping spring 24*a*, 24*b*
Contact wall 25
Main housing 26
Window-like opening 27
End portion 28
Fixing element 29
Busbar positioning element 30
Web element 31*a*, 31*b*
Rear wall 32
Opening 33
Latch element 34
Conductor insertion opening 35*a*, 35*b*
Pusher 36*a*, 36*b*
Side wall 37*a*, 37*b*
Side wall 38*a*, 38*b*

The invention claimed is:

1. A terminal block, comprising:
an insulator housing;
at least two busbars; and
at least four connection elements arranged one above the other so as to form at least two connection levels in the insulator housing, wherein each connection level includes:
a busbar receiving chamber, configured to receive one of the busbars, and
a first conductor connection chamber and a second conductor connection chamber, the conductor connection chambers being mutually opposite each other and formed on ends of the busbar receiving chamber, each conductor connection chamber being configured to receive a respective one of the connection elements,
wherein the busbar receiving chambers are formed open on a first side of the insulator housing for installation of the busbars in the busbar receiving chambers, wherein the conductor connection chambers are formed open on a second side of the insulator housing for installation of the connection elements in the conductor connection chambers,
wherein the first side of the insulator housing is formed perpendicular to the second side of the insulator housing, in such a way that a busbar installation insertion direction for inserting one of the busbars into the respective busbar receiving chamber is formed perpendicular to a connection element installation insertion direction for inserting one of the connection elements into the respective conductor connection chambers,
wherein at least one of the connection elements includes a busbar contact element configured to contact the connection element using at least one busbar,
wherein the busbar contact element is in the form of a fork contact, an insulation displacement contact, or a pierce contact,
wherein at least one of the busbar receiving chambers includes a busbar positioning element, and
wherein the busbar positioning element includes a guide configured to cooperate with at least one busbar contact element of at least one connection element.

2. The block of claim 1, wherein the busbars are in the form of a flat strip, a round wire, or a flexible conductor.

3. The block of claim 1, wherein at least one of the connection elements includes a spring clamp connection including a clamping spring and a contact wall.

4. The block of claim 1, wherein the busbar contact element is formed integrally with a contact wall of a spring clamp connection.

5. The block of claim 1, wherein the bulbar contact element is formed bent out from a contact wall of a spring clamp connection.

6. The block of claim 1, wherein the busbar contact element projects out from a spring clamp connection.

7. The block of claim 1,
wherein the busbar positioning element is arranged at an inclination to at least one busbar inserted into a busbar receiving chamber.

8. The block of claim 1,
wherein the busbar positioning element includes a first web element and a second web element arranged mutually parallel.

9. The block of claim 1, wherein at least one of the busbars includes an end portion which projects into one of the connection elements when installed.

10. The block of claim 9, wherein, when installed, the end portion of the busbar is positioned against a contact wall of a spring clamp connection inside the connection element.

11. The block of claim 10, wherein the spring clamp connection includes a fixing element which presses an end portion of the busbar against the contact wall when installed.

12. The block of claim 11, wherein the fixing element is formed as a lug bent out from the contact wall.

13. The block of claim 11, wherein the end portion of the busbar is formed fork-shaped and forms at least two contact points.

14. The block of claim 1, wherein a rear wall of the insulator housing includes an opening configured to insert a latch element into the insulator housing.

15. A terminal block, comprising:
an insulator housing;
at least two busbars; and
at least four connection elements arranged one above the other so as to form at least two connection levels in the insulator housing, wherein each connection level includes:
a busbar receiving chamber, configured to receive one of the busbars, and
a first conductor connection chamber and a second conductor connection chamber, the conductor connection chambers being mutually opposite each other and formed on ends of the busbar receiving chamber, each conductor connection chamber being configured to receive a respective one of the connection elements,
wherein the busbar receiving chambers are formed open on a first side of the insulator housing for installation of the busbars in the busbar receiving chambers, wherein the conductor connection chambers are formed open on a second side of the insulator housing for installation of the connection elements in the conductor connection chambers,
wherein the first side of the insulator housing is formed perpendicular to the second side of the insulator housing, in such a way that a busbar installation insertion direction for inserting one of the busbars into the respective busbar receiving chamber is formed perpendicular to a connection element installation insertion direction for inserting one of the connection elements into the respective conductor connection chambers, wherein at least one of the connection elements includes a busbar contact element configured to contact the connection element using at least one busbar, wherein the busbar contact element is in the form of a fork contact, an insulation displacement contact, or a pierce contact, wherein at least one of the busbar receiving chambers includes a busbar positioning element, and wherein the busbar positioning element is arranged at an inclination to at least one busbar inserted into a busbar receiving chamber.

16. A terminal block, comprising:

an insulator housing;

at least two busbars; and at least four connection elements arranged one above the other so as to form at least two connection levels in the insulator housing, wherein each connection level includes:

a busbar receiving chamber, configured to receive one of the busbars, and a first conductor connection chamber and a second conductor connection chamber, the conductor connection chambers being mutually opposite each other and formed on ends of the busbar receiving chamber, each conductor connection chamber being configured to receive a respective one of the connection elements, wherein the busbar receiving chambers are formed open on a first side of the insulator housing for installation of the busbars in the busbar receiving chambers, wherein the conductor connection chambers are formed open on a second side of the insulator housing for installation of the connection elements in the conductor connection chambers, wherein the first side of the insulator housing is formed perpendicular to the second side of the insulator housing, in such a way that a busbar installation insertion direction for inserting one of the busbars into the respective busbar receiving chamber is formed perpendicular to a connection element installation insertion direction for inserting one of the connection elements into the respective conductor connection chambers, wherein at least one of the connection elements includes a busbar contact element configured to contact the connection element using at least one busbar, wherein the busbar contact element is in the form of a fork contact, an insulation displacement contact, or a pierce contact, wherein at least one of the busbar receiving chambers includes a busbar positioning element, and wherein the busbar positioning element includes a first web element and a second web element arranged mutually parallel.

* * * * *